US006848843B1

(12) United States Patent
Kawaguchi

(10) Patent No.: US 6,848,843 B1
(45) Date of Patent: Feb. 1, 2005

(54) WIRE DOT PRINTER HEAD AND WIRE DOT PRINTER

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/655,280

(22) Filed: Sep. 3, 2003

(51) Int. Cl.[7] ..... B41J 2/275
(52) U.S. Cl. ..... 400/124.23; 400/124.11
(58) Field of Search ..... 400/124.23, 124.11, 400/124.2, 124.12

(56) References Cited

U.S. PATENT DOCUMENTS

| | | | | | |
|---|---|---|---|---|---|
| 4,881,832 | A | * | 11/1989 | Mitsuishi et al. | 400/124.23 |
| 4,988,223 | A | * | 1/1991 | Hilkenmeier et al. | 400/124.23 |
| 4,993,854 | A | * | 2/1991 | Sato | 400/124.23 |
| 6,698,956 | B1 | | 3/2004 | Terao | |

FOREIGN PATENT DOCUMENTS

| | | | | | |
|---|---|---|---|---|---|
| JP | 62101458 | A | * | 5/1987 | B41J/3/10 |
| JP | 04031061 | A | * | 2/1992 | B41J/2/275 |
| JP | 07-125265 | A | | 5/1995 | |
| JP | 09-187972 | A | | 7/1997 | |
| JP | 2001-219586 | A | | 8/2001 | |

OTHER PUBLICATIONS

U.S. Appl. No. 10/375,476, filed Feb. 28, 2003, entitled "An Impact Dot Print Head and a Printer Including The Same"; Inventor.

* cited by examiner

*Primary Examiner*—Daniel J. Colilla
(74) *Attorney, Agent, or Firm*—Frishauf, Holtz, Godman & Chick, P.C.

(57) ABSTRACT

A wire dot printer head of the present invention is configured by being provided with an abrasion preventive member which surrounds an outer circumference of support shafts of a plurality of armatures, between an armature spacer having a plurality of cutouts for respectively accommodating the support shafts of the plural armatures that respectively support printing wires, and a yoke which holds the support shafts of the plural armatures with the armature spacer. With this structure, the support shafts of the armatures do not directly contact with the yoke owing to the abrasion preventive member, thereby restraining abrasion of a surface of the yoke, and preventing a deterioration of printing quality.

12 Claims, 7 Drawing Sheets

WIRE DOT PRINTER HEAD AND WIRE DOT PRINTER

BACKGROUND OF THE INVENTION

1. Field of the Invention

The present invention relates to a wire dot printer head and a wire dot printer.

2. Discussion of the Background

A wire dot printer head is an apparatus which swings an armature coupled with a wire for printing between a printing position and a waiting position, and when the armature is swung to the printing position, a tip end of the wire comes into collision with a print medium, such as a sheet of paper, whereby printing is carried out.

As an example of such wire dot printer head as described above, in the gazette of Japanese Patent Application laid-open No. 2001-219586, there is disclosed an apparatus in which a magnetic flux induced by a coil around the armature to be swung generates a magnetic circuit for attracting the armature from the waiting position to the printing position, thereby executing a printing. As shown in FIG. 6 and FIG. 7, in the wire dot printer head 100 in the conventional art as described above, an armature 102 which supports a wire 101 for printing has a support shaft 103, and the armature 102 is provided in such a manner as rotatable around the support shaft 103. An armature spacer 105 having a cutout 104 for accommodating the support shaft 103 of the armature 102 is provided on a yoke 106 for generating the magnetic circuit. Further, on the armature spacer 105 there is provided a plate 108 for holding down the support shaft 103 so as to control a movement of the support shaft 103, via an elastic spacer 107 which fixes a position of the support shaft 103 of the armature 102 with elasticity. With this structure, it is possible to prevent an abrasion of the plate 108 due to the support shaft 103 of the armature 102, and thus the position of the support shaft 103 can be fixed.

However, with speed-enhancement in printing in recent years, the armature 102 has to swing between the printing position and the waiting position, for example, 2,500 times per second, thereby causing an intensive oscillation during the printing. As a result, the support shaft 103 being a center of rotational movement of the armature 102 may wear out a surface of the yoke 106. As the abrasion of the surface of the yoke 106 proceeds due to the support shaft 103 of the armature 102, the support shaft 103 of the armature 102 becomes movable and deviated from a predetermined position, causing unstable swinging movement of the armature 102. Consequently, this may become a factor which deteriorates a printing quality.

Furthermore, due to an oscillation according to the speedup in printing, the support shaft 103 of the armature 102 moves not only in the swinging direction of the armature 102 but also into a radial direction of the armature spacer 105. Then, it may also cause unstable swinging movement of the armature 102. Moreover, when the abrasion of the surface of the yoke 106 due to the support shaft 103 of the armature 102 proceeds, for example, the armature 102 may come into contact with a flange of the coil, or may erase the cutout 104 of the armature spacer 105 with a micro motion of the support shaft 103. Consequently, the life of the wire dot printer head 100 may be shortened.

SUMMARY OF THE INVENTION

Taking the above problems into account, an objective of the present invention is to provide a wire dot printer head and a wire dot printer which are capable of suppressing an abrasion of a surface of a yoke for obtaining a high speed printing and a high impact force, preventing a deterioration in printing quality, and obtaining a printing performance being stable for a long period of time.

This objective of the present invention can be achieved by a novel wire dot printer head a wire dot printer relating to the present invention.

According to the novel wire dot printer head and the wire dot printer of the present invention, there are provided an armature spacer having a plurality of cutouts for respectively accommodating support shafts of a plurality of armatures for supporting printing wires respectively, and a yoke for holding the support shafts of the plural armatures with the armature spacer, and between the armature spacer and the yoke, there is provided an abrasion preventive member surrounding outer circumferences of the support shafts of the plural armatures, whereby the support shafts of the armatures and the surface of the yoke do not come into contact directly with each other.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Hereinafter, the preferred embodiments of the present invention will be explained with reference to FIG. 1 to FIG. 5.

Figure 1:
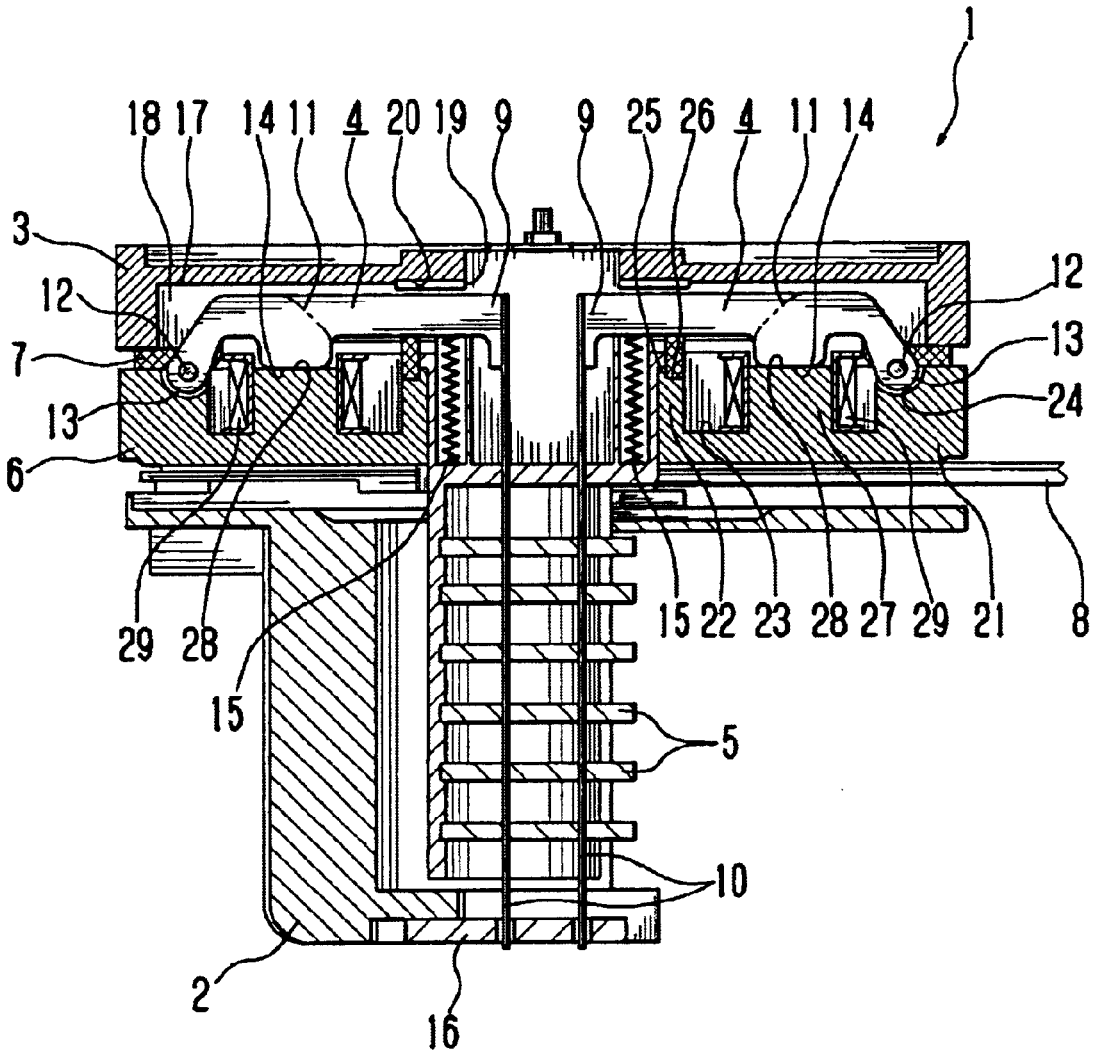
FIG. 1 is a central longitudinal sectional front view schematically showing a part of a wire dot printer head relating to the embodiment of the present invention.
Figure 2:
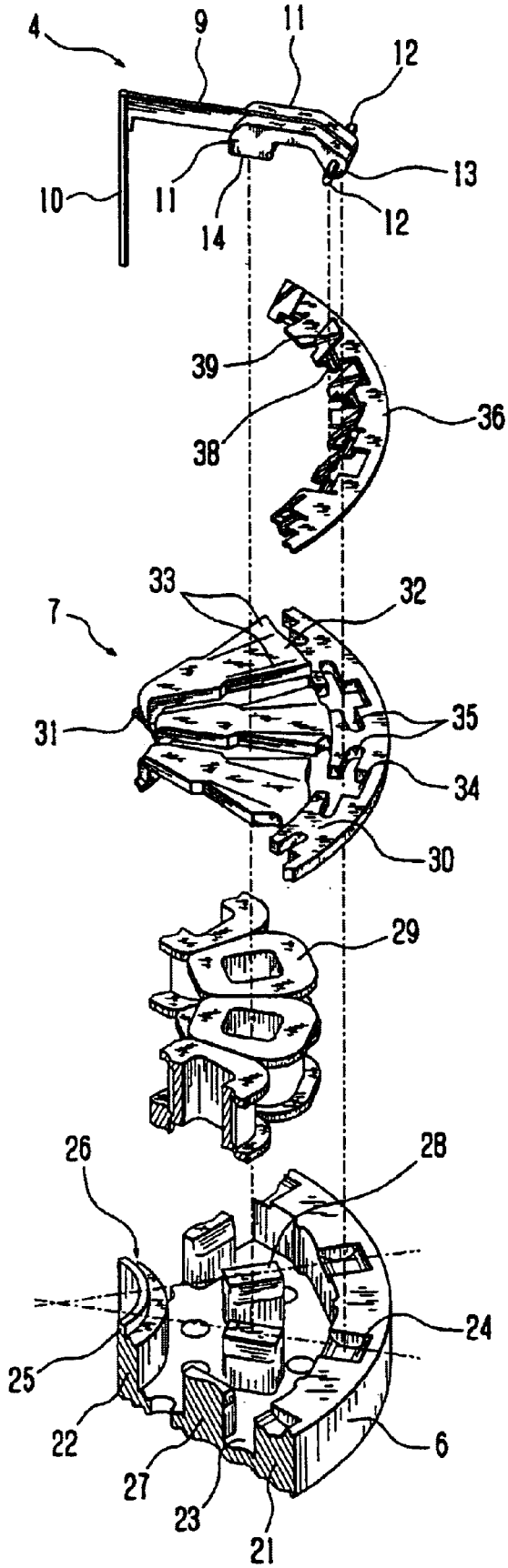
FIG. 2 is an exploded perspective view schematically showing a part of the wire dot printer head relating to the embodiment of the present invention.
Figure 3:
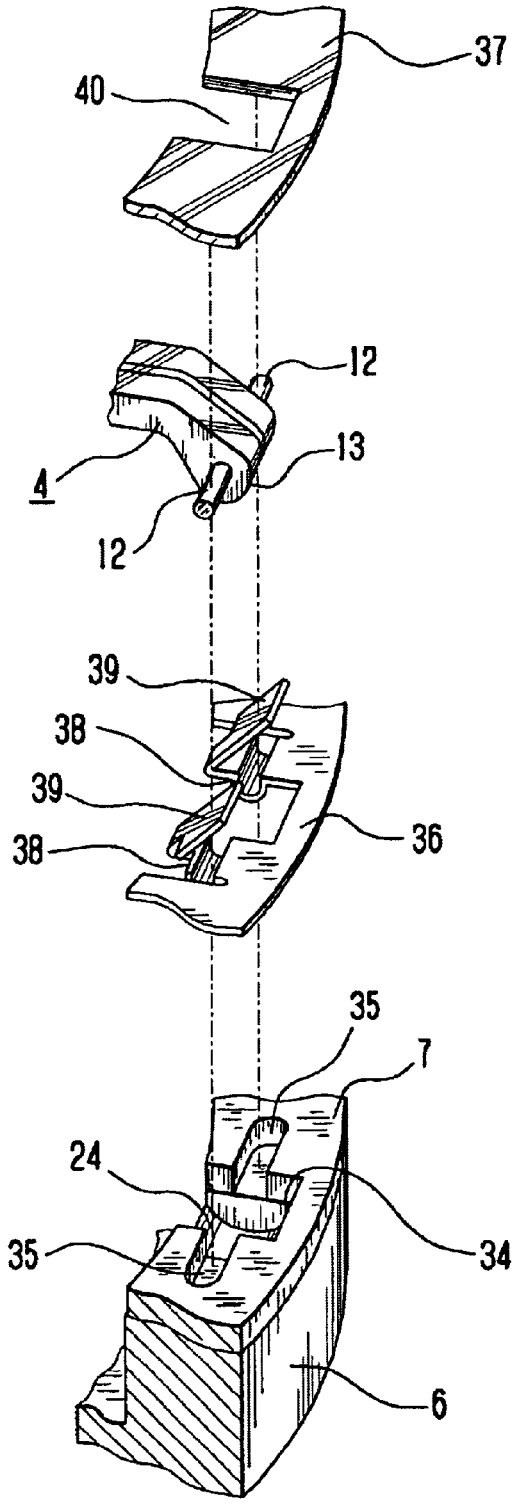
FIG. 3 is an exploded perspective view schematically showing a part of the wire dot printer head relating to the embodiment of the present invention.
Figure 4:
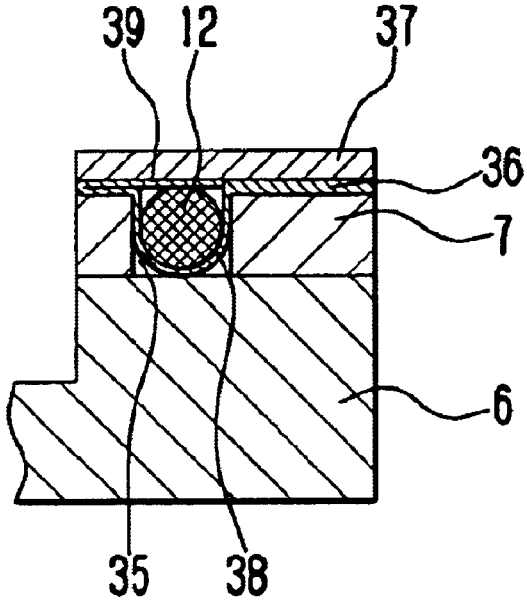
FIG. 4 is a longitudinal sectional side view schematically showing a part of the wire dot printer head relating to the embodiment of the present invention.

Firstly, an overall configuration of the wire dot printer head will be explained referring to FIG. 1 to FIG. 4. FIG. 1 is a central longitudinal sectional front view schematically showing a part of a wire dot printer head of the present embodiment, FIG. 2 and FIG. 3 are exploded perspective views schematically showing a part of the wire dot printer head, and FIG. 4 is a longitudinal sectional side view schematically showing a part of the wire dot printer head.

The wire dot printer head 1 has a front case 2 and a rear case 3, which are joined via fixing screws (not illustrated). Between the front case and the rear case, there are provided armatures 4, a wire guide 5, a yoke 6, an armature spacer 7 and a circuit board 8 or the like.

Each armature 4 comprises an arm 9, a printing wire 10 (hereinafter referred as "wire"), which is brazed on one end in the long direction of the arm 9, a magnetic circuit forming member 11 welded on both sides in the width direction of the arm 9, and a support shaft 12. Further, on the other end of the armature 4, an arc shaped section 13 is formed. A surface to be attracted 14 is provided on the magnetic circuit forming member 11, and the surface to be attracted 14 is positioned in a central part in the longitudinal direction of the armature 4.

A plurality of such armatures as described above are radially arranged with respect to the shaft center of the yoke 6. Then, those armatures 4 are rotatably supported on the surface of the yoke 6 respectively around the support shafts 12 in the direction moving away from the yoke 6. Further, they are pressed to a direction moving away from the yoke by pressure members 15.

When the armature 4 swings to the printing position, a tip end of the wire 10, along with the swing motion of the armature 4, moves to a predetermined position, i.e., a position where it comes into collision with a print medium, for example a sheet of paper and the like.

The wire guide 5 guides the wire 10 in slidable manner, so that the tip end of the wire 10 properly collides with the predetermined position on the print medium. In addition, a tip end guide 16 is provided in the front case 2, which allows the tip ends of the wires 10 to be arranged in a predetermined pattern and to guide the wires 10 in slidable manner.

On the rear case 3, a cylindrical shape section 18 with a bottom section 17 on one end is provided. On a central part of the bottom section 17, a concave portion 20 is formed for mounting an armature stopper 19, which is metallic and circular shaped. This armature stopper 19 is mounted in such a manner as fitted in the concave portion 20.

Here, when the armature 4 swings from the printing position by the pressure member 15, the arm 9 as a part of the armature 4 abuts against the armature stopper 19, and then, swinging of the armature 4 is stopped. Therefore, the armature stopper 19 has a function to fix a waiting position of the armature 4.

The circuit board 8 is provided with a circuit to control the swing motion of the armature 4 between the printing position and the waiting position. In printing operation, an arbitrary armature 4 can be selectively made swing, controlled by the circuit board 8.

The yoke 6 is made of a magnetic material, and has a pair of cylindrical members 21, 22, which are concentrically provided and have different diameters. Dimensions of the cylindrical members 21, 22, in the shaft center direction (vertical direction of FIG. 1, referred to as "shaft center direction of the yoke 6", hereinafter) are set to equal to each other. The cylindrical member 21 in the outer circumferential side and the cylindrical member 22 in the inner circumferential side are integrated via the bottom section 23, which is provided to block one side in the shaft center direction.

Here, in the present embodiment, the yoke 6 is fabricated by LostWax method, for example, using PMD as a material. The surface hardness of the yoke 6 is approximately Hv 330. The surface of the yoke 6 is subjected to a polishing process, ensuring a degree of flatness and surface roughness of predetermined values.

A plurality of recesses 24 are formed on the cylindrical member 21 in the outer circumferential side. The shape of those recesses 24 is concave, with the inner surface having a curvature radius approximately identical to that of the outer surface of the arc shaped section 13 of the armature 4. The number of those recesses 24 is identical to the number of the armature 4. The arc shaped sections 13 formed on one end of the armatures 4 are slidably fitted in the recesses 24, respectively.

A section to be engaged 25 having a circular shape is provided on the cylindrical member 22 in the inner circumferential side. The section to be engaged 25 is integrally provided on the cylindrical member 22 in such a manner that it is positioned concentrically with respect to the cylindrical member 22 in the inner circumferential side. The outer diameter of the section to be engaged 25 is set smaller than that of the cylindrical member 22 in the inner circumferential side. Therefore, with the section to be engaged 25, a step section 26 is formed on the cylindrical member 22 in the inner circumferential side.

On the bottom section 23, there are integrally provided a plurality of cores 27, which are arranged circularly between the cylindrical member 21 in the outer circumferential side and the cylindrical member 22 in the inner circumferential side. The dimension of each of the cores 27 in the shaft center direction of the yoke 6 is set to be equal to those of the cylindrical members 21, 22 in the shaft center direction of the yoke 6.

On one end of the cores 27 in the shaft center direction of the yoke 6, magnetic pole surfaces 28 are respectively provided. Each magnetic pole surface 28 of the core 27 is provided so that it is to be opposed to the surface to be attracted 14 of the magnetic circuit forming member 11 provided on the armature 4. Furthermore, on the outer circumference of the cores 27, coils 29 are mounted respectively. In other words, the yoke 6 includes a plurality of cores 27 circularly, each of the cores 27 being wound by the coil 29.

The yoke 6 as described above is held between the front case 2 and the rear case 3, in a state that the open side opposing to the bottom section 23 of the yoke 6 is faced to the open side of the rear case 3. It is to be noted that in the present embodiment, all the coils 29 are set to be wound in a same direction, but the winding direction is not limited. It may be possible to selectively dispose coils which are wound in different directions.

The armature spacer 7 has a pair of ring shaped sections 30, 31 having diameters which are approximately the same as those of the cylindrical members 21, 22, respectively, and a plurality of guide sections 32 radially bridged between the pair of the ring shaped sections 30, 31, so that each of the guide sections is positioned between the armatures 4. The ring shaped section 30 in the outer circumferential side and the ring shaped section 31 in the inner circumferential side are concentrically provided. The ring shaped section 30 in the outer circumferential side, the ring shaped section 31 in the inner circumferential, and the guide sections 32 are integrally molded.

When the armature spacer 7 is mounted on the yoke 6, the ring shaped section 30 in the outer circumferential side and the ring shaped section 31 in the inner circumferential side respectively abut against the cylindrical members 21, 22 of the yoke 6. Then, the ring shaped section 31 in the inner circumferential side is engaged with the section to be engaged 25. Here, the inside diameter of the ring shaped section 31 in the inner circumferential side is set to be equal or a little larger than the external diameter of the section to be engaged 25.

The guide sections 32 are respectively provided with side yoke sections 33 along nearly radial direction of the ring shaped sections 30, 31, into a direction moving away from the magnetic pole surface 28 of the core 27 and extending into the oblique direction. Each side yoke section 33 has a feather shape, the width of which becomes larger as it approaches to the ring shaped section 30 in the outer circumferential side from the ring shaped section 31 in the inner circumferential side.

Since a plurality of the guide sections 32 are bridged between the pair of the ring shaped sections 30, 31, guide grooves 34 of slit shape are provided, which are opened along the radial direction of the ring shaped sections 30, 31. Each of the guide grooves 34 is formed with a width dimension being close to that of the magnetic circuit forming member 11, within a degree that each of the guide sections 32 does not interfere with the swing motion of the armature 4.

The guide groove 34 communicates with the ring shaped section 30 in the outer circumferential side, and as to the guide groove 34 on the ring shaped section 30 in the outer circumferential side, bearing grooves 35, which are cutouts opened continuously from the guide groove 34, are formed on the both side positions of the guide groove 34, along the outer diameter direction of the ring shaped section 30. The support shaft 12 of the armature 4 is fitted in the bearing groove 35. In other words, the support shafts 12 of the armatures 4 are held by the yoke 6 and the armature spacer 7, in such a manner that the plural armatures 4 are respectively opposed to the plural cores 27.

On the armature spacer 7, an abrasion preventive member 36 surrounding the outer circumference of the support shafts 12 of the plural armatures 4 is mounted. Further on this abrasion preventive member 36, a pressing member 37 for holding down the support shafts 12 of the plural armatures 4. In other words, the abrasion preventive member 36 is provided between the armature spacer 7 and the pressing member 37.

The abrasion preventive member 36 is circular shaped so that it does not interfere with swinging motion of the plural armatures 4. The abrasion preventive member 36 is made of, for example, plate member obtained by conducing heat treatment on SK material, and is provided on the yoke 6 so as to create a magnetic path with the shortest distance between the core 27 on the yoke 6 and the armature 4. It is to be noted that the surface hardness of the abrasion preventive member 36 is at least Hv 500. The abrasion preventive member 36 has a high hardness and is superior in wear resistance, and made of a material having an excellent magnetic permeability. Further, this member also has toughness.

The abrasion preventive member 36 comprises the first covering sections 38 which cover the support shafts 12 of the plural armatures 4 from the armature spacer 7 side, and the second covering sections 39 which are respectively integrated with the plural first covering sections 38, and respectively cover the support shafts 12 of the plural armatures 4 from the pressing member 37 side.

The first covering section 38 is formed in a shape so that it corresponds to the shape of the bearing groove 35. The second covering section 39 is formed by bending a part of the first covering section 38 in such a manner as being movable towards/away from the first covering potion 38. In detail, the second covering potion 39 is formed by bending a part of the first covering section 38 into the outer circumferential direction of the armature spacer 7, and it is movable towards/away from the first covering section 38, with an elastic force due to bending. Further, the second covering section 39 is configured such that inserting the support shaft 12 of the armature 4 between the first covering section 38 and the second covering section 39 is made more smoothly by adjusting the bending amount.

The pressing member 37 is a member for holding down the support shafts 12 of the plural armatures 4, by coupling the front case 2 and the rear case 3 via the fixing screws. This pressing member 37 is circularly shaped. Further, the pressing member 37 has a groove section 40 extending to a radial direction of the armature 4, having nearly same width dimension as that of the armature 4, so that the pressing member 37 may not interfere with swinging thereof.

Figure 5:
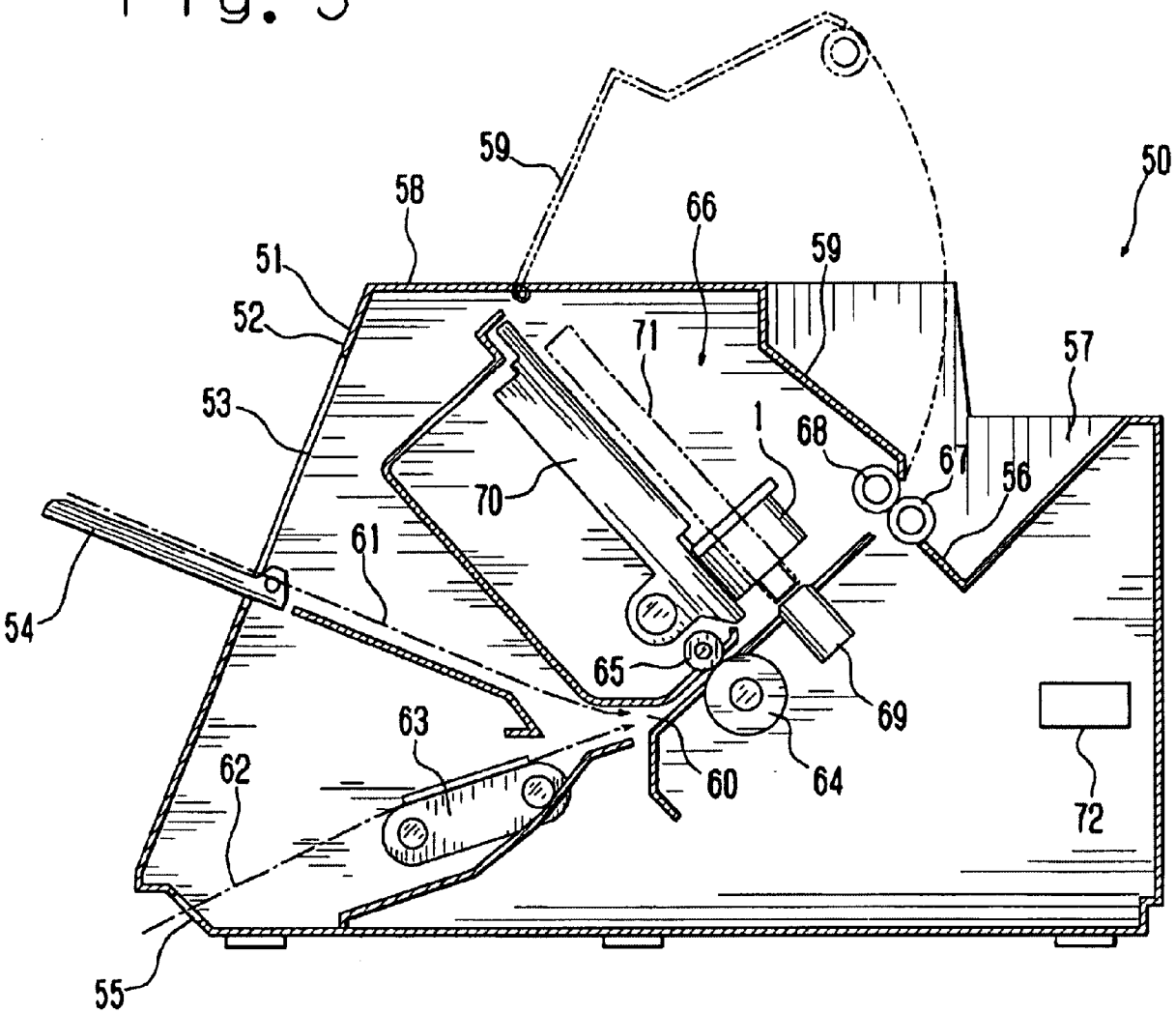
FIG. 5 is a longitudinal sectional side view schematically showing the wire dot printer relating to the embodiment of the present invention.
Figure 6:
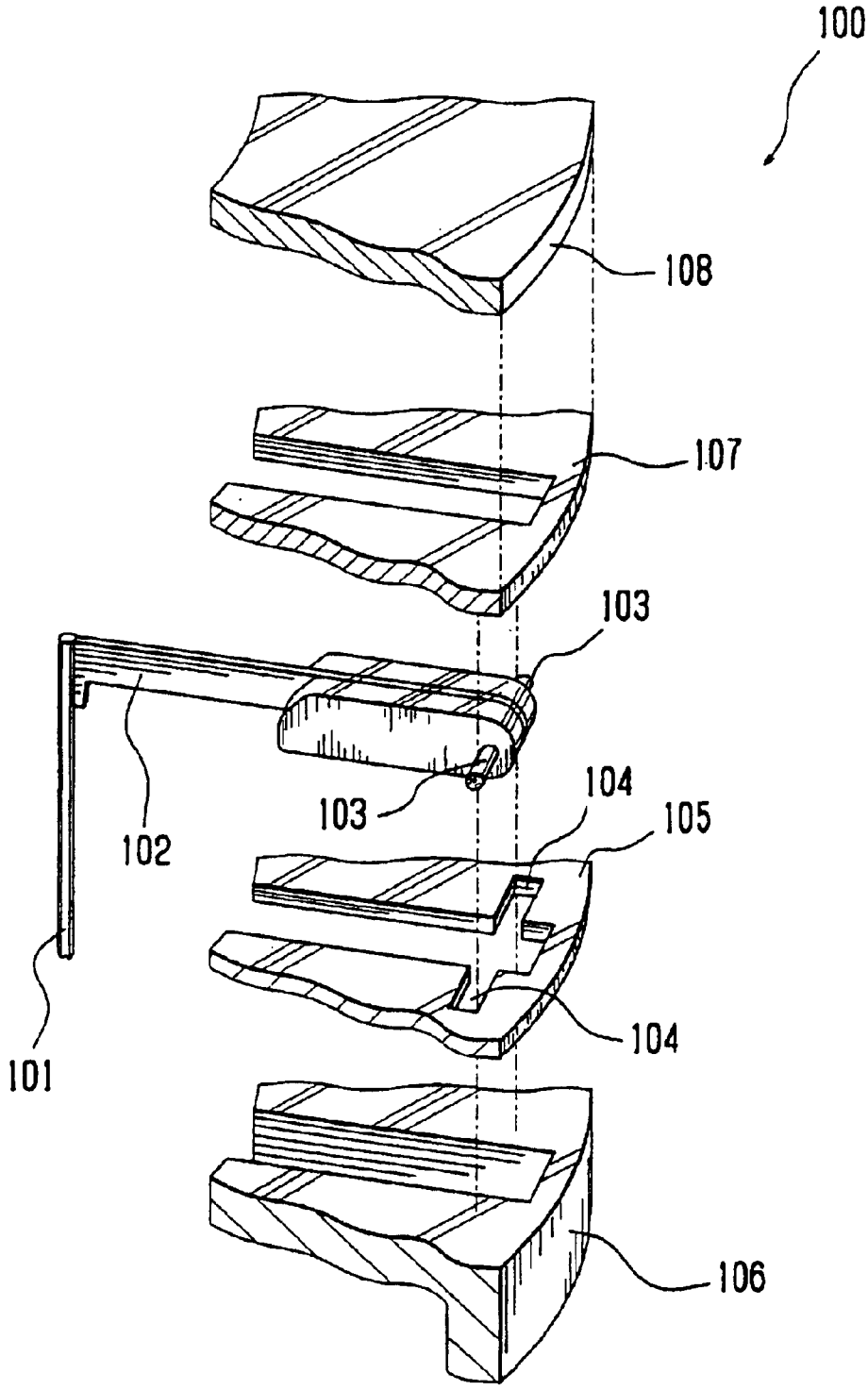
PRIOR ART Fig. 6
FIG. 6 is an exploded perspective view schematically showing a part of a conventional wire dot printer head.
Figure 7:
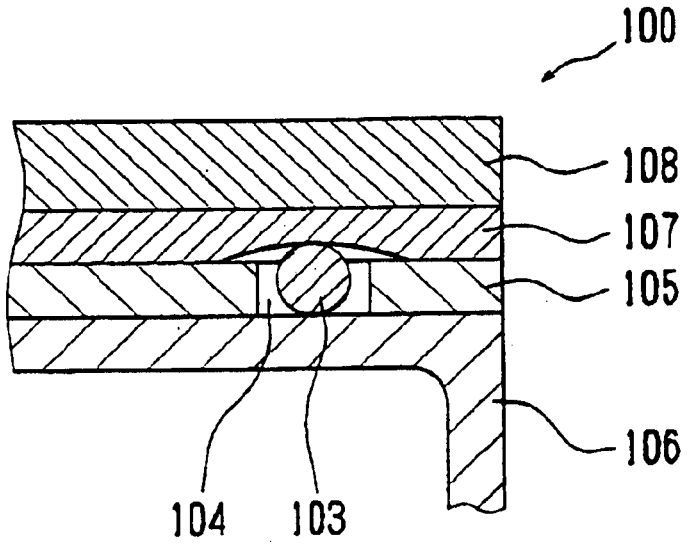
PRIOR ART Fig. 7
FIG. 7 is a longitudinal sectional side view schematically showing a part of the conventional wire dot printer head.

Next, a wire dot printer having the wire dot printer head 1 as described above will be explained with reference to FIG. 5. FIG. 5 is a longitudinal sectional side view schematically showing the wire dot printer relating to the embodiment of the present invention.

The wire dot printer 50 is provided with a main body case 51. An opening 53 is formed on the front surface 52 of the main body case 51. In the opening 53, a manual feeding tray 54 is mounted in openable and closable manner. On the lower part of the front surface 52 of the main body case 51, a paper feed port 55 is formed, and a paper discharge stacker 57 is provided on the side of a back surface 56. Further, an openable and closable cover 59 is rotatably mounted on the upper surface 58 of the main body case 51. Here, the openable and closable cover 59 in opened state is indicated by an imaginary line in FIG. 5.

A paper conveying path 60, which is a conveying path for a print medium, is provided within the main body case 51. Upstream of the paper conveying direction of the paper conveying path 60 is connected to a paper feeding passage 61 disposed on a surface extending from the manual feeding tray 54 in opened state, and a paper feeding passage 62 which continues to the paper feed port 55. On the other hand, down stream of the paper conveying direction is connected to the paper discharge stacker 57. A tractor 63 for conveying a sheet of paper is provided on the paper feeding passage 62.

On the paper conveying path 60, a conveying roller 64 and a pressing roller 65 are arranged in such a manner as opposed to each other, and the pressing roller 65 is pressed to contact with the conveying roller 64. Those conveying roller 64 and the pressing roller 65 convey a sheet of paper as a print medium, and also configure a paper conveying section, which is a section for conveying a print medium. Furthermore, on the paper conveying path 60, a printing section 66 for carrying out printing action on the paper which is conveyed. At the inlet of the paper discharge stacker 57, a paper discharge roller 67 is provided. The pressing roller 68 which is pressed to come into contact with the paper discharge roller 67 is rotatably supported on the side of free end of the openable and closable cover 59.

The printing section 66 comprises a platen 69 disposed within the paper conveying path 60, a carriage 70 which is reciprocable in the direction orthogonal to the paper conveying path 60, along the platen 69, the wire dot printer head 1 as described above, which is mounted on the carriage 70, an ink ribbon cassette 71 and the like. Here, it is to be noted that the ink ribbon cassette 71 is detachably mounted.

The carriage 70 is driven by a motor (not illustrated) and performs reciprocating motion along the platen 69. The wire dot printer head 1 also moves in reciprocating manner in a main scanning direction with the reciprocating motion of the carriage 70 along the platen 69. Therefore, in the present embodiment, a head driving mechanism is implemented by the carriage 70, the motor and the like. In addition, the wire dot printer 50 contains a driving controller 72 for controlling each part within the main body case 51. The driving controller 72 controls driving of each part, such as the printing section 66, the tractor 63, and the motor.

In the configuration as described above, if a cut paper is used as a sheet of paper, it is fed through the manual feeding tray 54, whereas if continuous forms are used, they are fed through the paper feed port 55. In any way of feeding used, the sheet of paper is conveyed via the conveying roller 64 and discharged on the paper discharge stacker 57 by the paper discharge roller 67. During the process above, printing is carried out by the wire dot printer head 1.

Printing is carried out with the following steps: In the wire dot printer head 1, the coil 29 is selectively excited, the armature 4 is attracted to the magnetic pole surface 28 of the core 27, and it rotates around the support shaft 12. Then, the wire 10 is pressed against the sheet of paper (not illustrated) on the platen 69 via the ink ribbon (not illustrated). When the power distribution to the coil 29 is interrupted, the armature 4 returns by the pressing force of the pressure member 15 and stopped at the waiting position by the armature stopper 19.

In detail, in order to carry out printing action by the wire dot printer 50, when the coil 29 is selectively energized based on the printing data by the control of the driving controller 72, from the core 27 to which the selected coil 29 is mounted, a magnetic circuit is generated by way of a magnetic circuit forming member 11 of the armature 4 which is positioned to be opposed to the core 27, a pair of side yoke sections 33 opposed to the magnetic circuit forming member 11, through between the cylindrical member 21 in the outer circumferential side and the cylindrical member 22 in the inner circumferential side of the yoke 6, and again back to the core 27 from the bottom section 23.

With the magnetic circuit thus generated, there occurs an attracting force to attract the magnetic circuit forming member 11 towards the magnetic pole surface 28 of the core 27, between the surface to be attracted 14 of the magnetic circuit forming member 11 and the magnetic pole surface 28 of the core 27. Due to this attracting force, the armature 4 swings in the direction that the surface to be attracted 14 of the magnetic circuit forming member 11 is attracted to the magnetic pole surface 28 of the core 27. It is to be noted that in the present embodiment, a position where the surface to be attracted 14 abuts against the magnetic pole surface 28 of the core 27 is defined as a printing position.

Along with the swing of the armature 4 to the printing position, the tip end of the wire 10 protrudes to the paper side. In the present embodiment, since the ink ribbon (not illustrated) exists between the wire dot printer head 1 and the paper, printing is carried out by transmitting the pressure of the wire 10 to the paper via the ink ribbon and ink on the ink ribbon is transferred to the paper.

When the power distribution to the coil 29 is interrupted, the magnetic flux having been generated disappears, and then, the magnetic circuit also disappears. Accordingly, the attracting force to attract the magnetic circuit forming member 11 to the magnetic pole surface 28 of the core 27 is also lost, the armature 4 is pressed to a direction moving away from the yoke 6, with the pressing force of the pressure member 15. Then, the armature 4 swings towards the waiting position around the support shaft 12. The armature 4 swings to the waiting position as described above, and the arm 9 abuts against the armature stopper 19, so that it is stopped at the waiting position. The printing motion as described above is performed at a high speed.

At this timing, the armature 4 swings between the printing position and the waiting position, for example, 2,500 times per second. However, with a function of the abrasion preventive member 36, the support shaft 12 of the armature 4 does not directly come into contact with the yoke 6 and the pressing member 37. Therefore, it is possible to suppress abrasion of the surface of the yoke 6 and the surface of the pressing member 37. Consequently, a long life of the wire dot printer head 1 can be secured and it is also possible to prevent deterioration of printing quality.

Further in the present embodiment, the abrasion preventive member 36 comprises a plurality of first covering sections 38 respectively covering the support shafts of the plural armatures 4 from the armature spacer 7 side, and the second covering sections 39 which are integrally formed on the plural first covering sections 38 respectively, so as to cover the support shafts 12 of the plural armatures 4 respectively from the pressing member 37 side. Therefore, it is possible to restrain the abrasion of the surface of the yoke 6 with a simple structure.

Further in the present embodiment, the second covering section 39 is formed by bending a part of the first covering section 38, in such a manner as being movable towards/away from the first covering potion 38. With this structure, it is possible to insert the support shaft 12 of the armature 4 between the first covering section 38 and the second covering section 39 more smoothly, and the armature 4 can be easily attached or detached.

Further in the present embodiment, since a part of the first covering section 38 is bent towards the outer circumferential direction of the armature spacer 7, it is easy to confirm a position for inserting the support shaft 12 of the armature 4 between the first covering section 38 and the second covering section 39, and then insertion of the support shaft 12 therebetween can be smoothly performed. Therefore, attaching and detaching of the armature 4 are simplified.

Further in the present embodiment, since the abrasion preventive member 36 is circularly shaped, swinging of the armature 4 is not interfered even in a simple structure, and in addition, the abrasion preventive member 36 as well can be easily attached or detached.

Further in the present embodiment, since the abrasion preventive member 36 is made of a material with an excellent magnetic permeability, a good magnetic circuit is generated, thereby achieving stable swinging motion of the armature 4.

It is to be noted that in the present embodiment, a sheet of paper is used as a print medium, but it is not limited thereto. For example, it is possible to use a pressure-sensitive colored paper, on a pressed part of which is colored. When the pressure-sensitive colored paper is used as the print medium, printing is carried out by coloring the part to which a pressure is applied by the wire 10 mounted on the wire dot printer head 1.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head comprising:

a plurality of armatures which respectively support printing wires and respectively have support shafts each functioning as a rotational center;

a yoke which has a plurality of cores respectively wound by coils, and holds the support shafts of the plural armatures in such a manner that the plural armatures are respectively opposed to the cores;

an armature spacer mounted on the yoke, which has a plurality of cutouts for accommodating the support shafts of the plural armatures, so that the plural armatures are allowed to swing without restraint, and holds the support shafts of the plural armatures with the yoke;

a pressing member mounted on the armature spacer, which is formed so as not to interfere with swinging motion of the plural armatures and holds down the support shafts of the plural armatures; and an abrasion preventive member provided between the armature spacer and the pressing member, which is formed so as not to interfere with the swinging motion of the plural armatures, and surrounds an outer circumference of the support shafts of the plural armatures.

2. A wire dot printer head according to claim 1, wherein, the abrasion preventive member comprises, a plurality of first covering sections which respectively cover the support shafts of the plural armatures from the armature spacer side, and a plurality of second covering sections which are formed integrally with the plural first covering sections respectively, and cover the support shafts of the plural armatures respectively from the pressing member side.

3. A wire dot printer head according to claim 2, wherein, each of the second covering sections is formed by bending a part of each of the first covering sections in such a manner as movable towards/away from the first covering section.

4. A wire dot printer head according to claim 3, wherein, the part of each of the first covering section is bent towards an outer circumferential direction of the armature spacer.

5. A wire dot printer head according to claim 1, wherein, the abrasion preventive member is circularly shaped.

6. A wire dot printer head according to claim 1, wherein, the abrasion preventive member is made of a material having an excellent magnetic permeability.

7. A wire dot printer comprising:

a wire dot printer head according to claim 1;

a platen opposed to the wire dot printer head;

a carriage holding the wire dot printer head and reciprocating along the platen;

a medium to-be-printed conveying section which conveys a print medium between the wire dot printer head and the platen; and a driving controller which drives the wire dot printer head, the carriage and the print medium transfer unit, based on the printing data.

8. A wire dot printer comprising:

a wire dot printer head according to claim 2;

a platen opposed to the wire dot printer head;

a carriage holding the wire dot printer head and reciprocating along the platen;

a print medium transfer unit which conveys a print medium between the wire dot printer head and the platen; and a driving controller which drives the wire dot printer head, the carriage and the print medium transfer unit, based on the printing data.

9. A wire dot printer comprising:

a wire dot printer head according to claim 3;

a platen opposed to the wire dot printer head;

a carriage holding the wire dot printer head and reciprocating along the platen;

a print medium transfer unit which conveys a print medium between the wire dot printer head and the platen; and a driving controller which drives the wire dot printer head, the carriage and the print medium transfer unit, based on the printing data.

10. A wire dot printer comprising:

a wire dot printer head according to claim 4;

a platen opposed to the wire dot printer head;

a carriage holding the wire dot printer head and reciprocating along the platen;

a print medium transfer unit which conveys a print medium between the wire dot printer head and the platen; and a driving controller which drives the wire dot printer head, the carriage and the print medium transfer unit, based on the printing data.

11. A wire dot printer comprising:

a wire dot printer head according to claim 5;

a platen opposed to the wire dot printer head;

a carriage holding the wire dot printer head and reciprocating along the platen;

a print medium transfer unit which conveys a print medium between the wire dot printer head and the platen; and a driving controller which drives the wire dot printer head, the carriage and the print medium transfer unit, based on the printing data.

12. A wire dot printer comprising:

a wire dot printer head according to claim 6;

a platen opposed to the wire dot printer head;

a carriage holding the wire dot printer head and reciprocating along the platen;

a print medium transfer unit which conveys a print medium between the wire dot printer head and the platen; and a driving controller which drives the wire dot printer head, the carriage and the print medium transfer unit, based on the printing data.

* * * * *